United States Patent [19]

Stainbrook

[11] Patent Number: 4,647,017

[45] Date of Patent: Mar. 3, 1987

[54] VACUUM HEAT TREATING FURNACE AND QUENCH SYSTEM WITH DROP TRANSFER

[76] Inventor: Norbert E. Stainbrook, 423 Sunnyside Ave., Meadville, Pa. 16335

[21] Appl. No.: 683,623

[22] Filed: Dec. 19, 1984

[51] Int. Cl.[4] ..... C21D 9/00

[52] U.S. Cl. ..... 266/89; 266/130; 266/250

[58] Field of Search ..... 266/250, 130, 132, 128, 266/259, 127, 89

[56] References Cited

U.S. PATENT DOCUMENTS

| | | | |
|---|---|---|---|
| 3,522,357 | 7/1970 | Pine et al. | 266/250 |
| 3,589,696 | 6/1971 | Westeren et al. | 266/250 |
| 3,866,891 | 2/1975 | Kalbfleisch | 266/250 |
| 4,063,719 | 12/1977 | Stephens et al. | 266/130 |

FOREIGN PATENT DOCUMENTS

| | | | |
|---|---|---|---|
| 70347 | 1/1983 | European Pat. Off. | 266/132 |
| 2924270 | 12/1980 | Fed. Rep. of Germany | 266/250 |
| 1554834 | 1/1969 | France | 266/250 |
| 16924 | 1/1984 | Japan | 266/250 |

*Primary Examiner*—Christopher W. Brody
*Attorney, Agent, or Firm*—Charles L. Lovercheck; Wayne L. Lovercheck; Dale R. Lovercheck

[57] ABSTRACT

A vacuum heat treating furnace and quench system in which a load hanger rod with attached load is suspended vertically from the vacuum chamber top cover assembly, and at the end of the heating cycle segment is unlatched and permitted to free-fall through the opened passageways into the quenching medium.

17 Claims, 11 Drawing Figures

VACUUM HEAT TREATING FURNACE AND QUENCH SYSTEM WITH DROP TRANSFER

BACKGROUND OF THE INVENTION

This invention relates to a vacuum heat treating furnace and quench tank system having a system for quickly moving the workpiece from the heat chamber to the quench tank.

Heat treat furnace and quench tank systems in which metals are heated and then quenched in a liquid to obtain a rapid cool of the metal are known in the art. The heat treatment of metals is generally defined as a combination of heating and cooling operations timed and applied to a metal or alloy in the solid state in a way that will produce desired properties.

U.S. Pat. No. 3,429,563 to Anderson et al and U.S. Pat. No. 3,522,357 to Pine et al are two examples of heat treating furnaces and quench tank structures.

The vacuum heat treat furnaces and particularly those with liquid quench mediums are currently being developed and applied more extensively. They provide some unique and extreme capabilities not obtainable in conventional heat treat furnaces. These vacuum heat treat furnaces can easily operate at temperatures to 3000° F. and above and to vacuum levels of $10^{-7}$ mm Hg. and below.

These vacuum heat treat furnaces are cycled from ambient conditions to operating temperature and vacuum levels repeatedly. Many difficulties are encountered during operation. It is a problem to provide a reliable and quick transfer of the load or workpiece to the quench medium. It is also a problem to achieve and maintain a vacuum environment that is constant and free of contaminents, and to keep both the internals of the furnace and the parts being heat treated free from foreign material and contamination.

A common problem encountered with prior art devices results from the vaporization of some of the quench liquid which would occur when, for example, a load is placed in the quench. The subsequent condensation and deposition of the liquid vapor on not only furnace interior parts, but also, on load parts being heat treated contaminates the load and results in the derogation of the heat treating process. This is particularly true of liquid mediums, such as water, that have comparatively high vapor pressures, and is also true of quench oils with substantially lower vapor pressures. In some of the prior devices there is direct line of sight exposure between the heating zone chamber and the liquid quench surface throughout the quench period. These extended periods of open unobstructed passageways between heating zone chamber and liquid quench surface permits and promotes vapor movement.

Another frequent source of contamination is the alternate exposure of furnace operating parts to the quench liquid and then directly to the furnace heating zone interior. Typical examples of such furnace operating parts are load support rails, elevator and hoist parts, chains, cables and hooks. These parts move from the heating zone chamber to the quench chamber and then return to the heating zone chamber as they convey workpieces from the heat treatment to the quench. This source of contamination is especially troublesome with liquid mediums of comparatively low vapor pressures, such as oil.

In many of the prior art devices there is extensive use of mechanical linkages, components and motions to transfer the load between the heating zone and the quench tank. These complicated mechanisms are not only a source of mechanical operating problems, but also impose an undesirable time lag between the end of heat and quench.

The problems outlined above have been known, experienced and tolerated, for many years, and have been accepted as characteristic of vacuum heat treat equipment. Although there has been continuous effort, for many years, by the heat treating industry, to circumvent and solve these problems, there has been no complete solution to date. My invention solves these problems.

SHORT STATEMENT OF THE INVENTION

This invention relates to the means and method of loading and transferring loads in a vacuum heat treat furnace, between the heating chamber and the quench tank. It provides a simple, reliable and unique means for handling and transferring loads.

The furnace and quench tank system is basically a vertical arrangement which is divided into a heating chamber at the upper section and a moveable quench tank at the bottom. When conditions warrant, a pivotable underside hot-zone assembly and/or a vacuum gate valve may be interposed between the heating chamber and the moveable quench tank.

The chamber top cover assembly of the system is removable, and contains support which may be a compound latch-unlatch means from which the load is suspended. The compound latch-unlatch assembly is unique in that it is suitable for use in a high temperature, hard vacuum furnace. The assembly is mounted on the external side of the top cover assembly and is cooled by the cooling means of the top cover, or other means, if more appropriate. A load hanger rod or wire is inserted into this assembly from the underside of the chamber top cover assembly.

In addition to the economics associated with size, the small scale furnace provides advantageous short time cycles for the time segment of load transfer from the heating zone to the quench medium. The compactness of the configuration and the arrangement of the disclosed furnace components permits movement and cycle times such shorter than is now possible with the prior art devices.

One of the advantages of the preferred embodiment of the present invention, is that it minimizes the time for quench liquid vapors to migrate into the furnace heating zone interior by permiting the passageway to be open only during the free-fall period of the load assembly.

Another advantage is that there is no component of the furnace system that moves directly from the quench tank into the furnace heating zone interior, and consequently, there is no carry over of quenchant into the hot zone.

Still another advantage of this invention is that, by utilizing gravity and permitting free-fall of the load assembly from the heating zone to the quench liquid, the associated transfer equipment and problems are eliminated.

A further advantage is that the transfer time, from heating zone to quench liquid is very short, and it is a function of distance only.

These and other objectives and advantages of the present invention will be more readily apparent from a consideration of the following detailed description of drawings.

DETAILED DESCRIPTION OF THE PREFERRED EMBODIMENT

Figure 1:
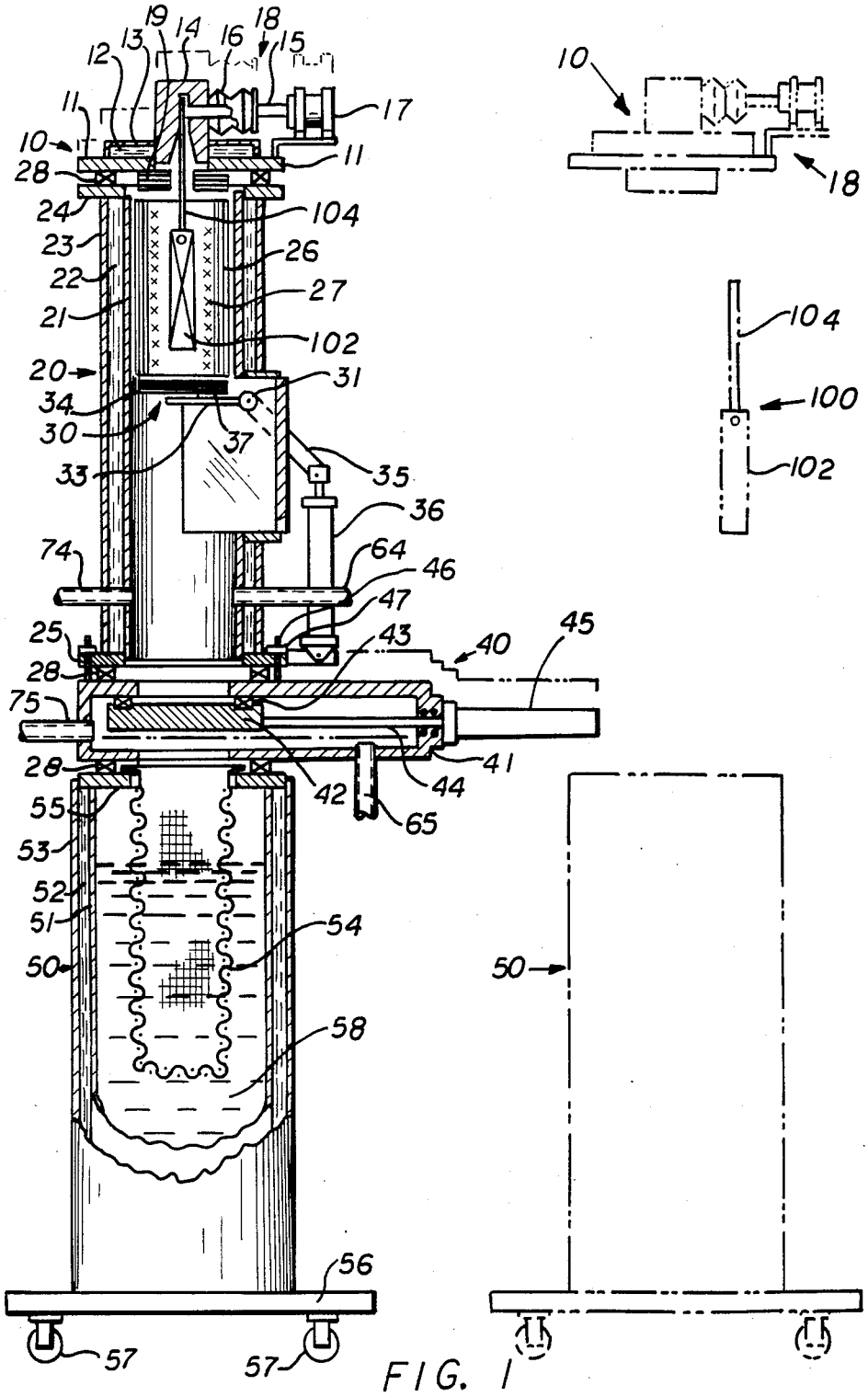
FIG. 1 is a cross-sectional elevation view of a preferred embodiment of the furnace system, during the vacuum-heating mode, and further illustrates remote locations of system components.

The preferred embodiments of the present invention are illustrated by way of example in FIGS. 1–10. With specific reference to FIG. 1, the apparatus includes a vacuum heating chamber assembly 20, a movable chamber top cover assembly 10, a pivot hinged underside heat zone assembly 30, a vacuum gate valve assembly 40 and a quench tank assembly 50.

The vacuum heat treat furnace system of FIG. 1 is intended for operation within temperature ranges of 0° F. to 3000° F. and pressure levels ranging from $10^{-7}$ mm.Hg. to 15 psig.

The term, pressure level, is used to indicate any pressure from absolute zero to above atmospheric pressure, within the forestated operating range.

Figure 2:
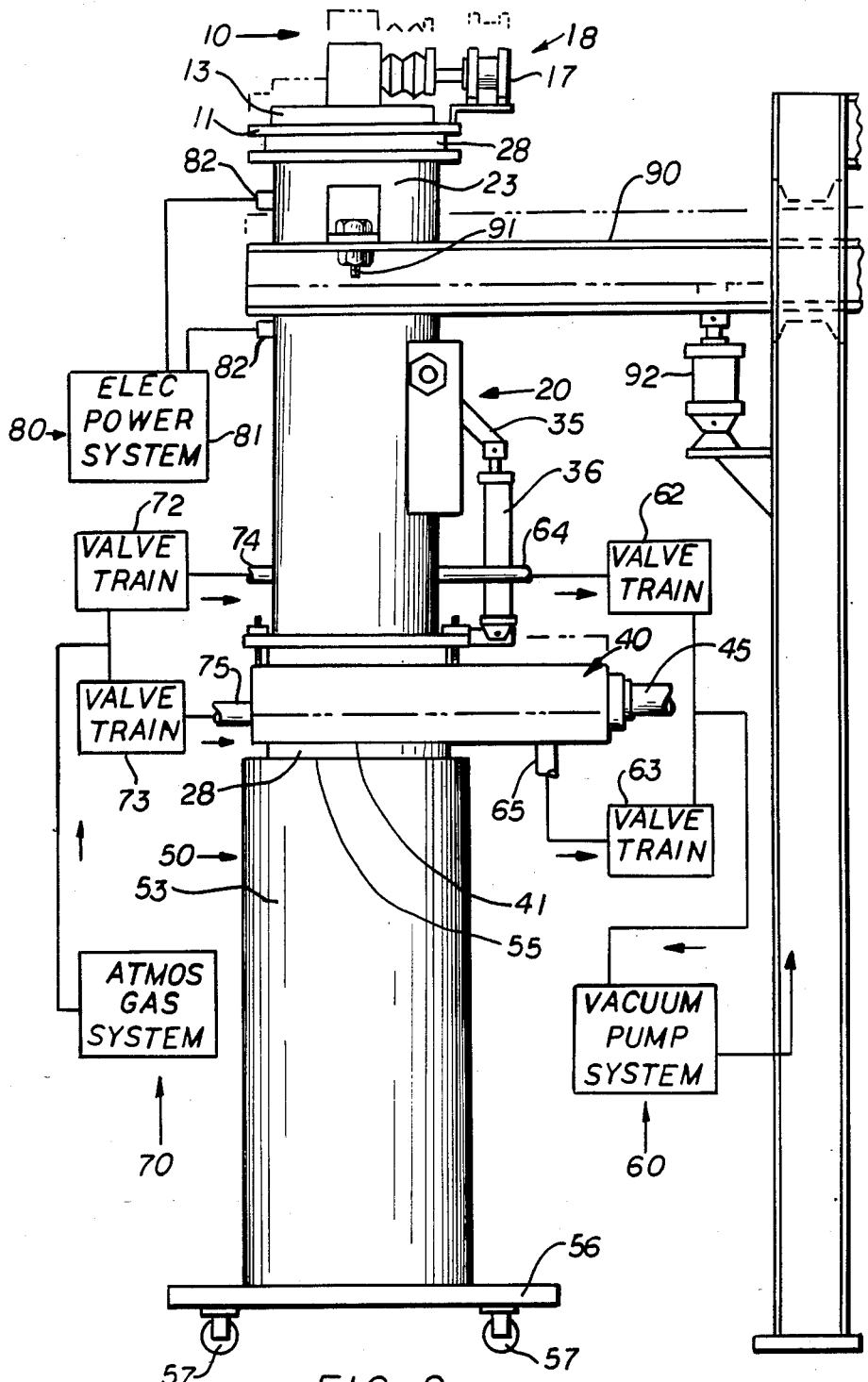
FIG. 2 is an outside elevation view of the vacuum heat treat furnace system along with single line schematics of the power, atmosphere gas, and vacuum pumping systems.

As illustrated in FIG. 2, connected to the furnace system are conventional, suitable, and adequate, vacuum pumping system assembly 60, atmosphere backfill and pressure level control system 70, and an electric heat power system 80, to achieve the temperature and pressure levels desired.

FIG. 2 further illustrates the support system for the vacuum heating chamber assembly 20, and the vacuum gate valve assembly 40. The support member 90 and vacuum chamber 20 are fastened together by the nut and bolts connectors 91. The support member 90 has a cylinder actuator 92, or other conventional actuating means, to slightly raise and lower the said chamber and valve assemblies.

When the quench tank assembly 50 is in its operating position, as shown in FIG. 2, the actuator 92 is in its lowered position, and to the extent that the interface surfaces of the valve housing 41 and quench tank top flange 55 make full and sufficient contact with the vacuum gasket seal 28 to permit and maintain vacuum operation.

When the support actuator 92 along with the chamber 20 and valve assembly 40 are in the raised position, a clearance exists between the tank top flange 55 and the valve housing housing 41. At this condition the quench tank asembly 50 may be moved to and from its operating position.

The type of vacuum furnace embodied in this invention is the cold wall type, wherein the heating chamber enclosure casings are liquid cooled, generally with water. The cooling means illustrated in FIG. 1 is the double wall construction with the cooling medium 12, 22 and 52 circulating through the space between the inner casing 21 and the outer casing 23 of the vacuum chamber, the cover head 11 and the outer casing 13 of the top cover assembly 10, and the inner casing 51 and outer casing 53 of the quench tank assembly 50. It is understood, that, for occasional operation, the quench tank need not be water cooled. The external water source, water circuits, and drain system are not illustrated. Other conventional means such as tracing the exterior surfaces with cooling coils, may also be employed to achieve the cold wall nature of the vacuum furnace system.

Contained within the vacuum heating chamber assembly 20, are the hot zone components which generally consist of the heating elements 27, the chamber wall insulation 26, the top cover insulation 19 and the underside insulation 34. The heating source within the chamber are the heating elements 27 which may be metallic, graphite felt, solid graphite or other material suitable for high temperature, vacuum service. The hot zone shielding insulation materials and construction of 19, 26 and 34 confine the heating space and may be metallic shielding, graphite in any of its various forms, ceramic fiber, or materials, or combination of materials suitable for high temperature vacuum service.

The vacuum valve assembly 40, is attached to the chamber assembly 20 in a solid manner so as to form a combined unit. A vacuum gasket seal 28, is interposed between the mating surfaces of the chamber bottom flange 25 and the valve housing 41, and clamped together by means of studs 46, and nuts 47, to maintain the vacuum integrity of the connection.

The top cover assembly 10, and the quench tank assembly 50 are movable assemblies. During the complete cycle of operation, the above said assemblies are moved to and from their respective furnace positions as shown in FIG. 1. These remote locations are indicated by the outlines shown with dotted lines, where loading and unloading occur. When the above said assemblies of 10 and 50 are cooperating with the unitized vacuum chamber 20 and valve assembly 40, the vacuum gasket seals 28 are interposed at the respective interface surfaces. The machined interface surfaces of the cover head 11, the chamber top flange 24, the valve housing 41 and the tank top flange 55 in conjunction with the vacuum gasket seals 28 and clamping means, where necessary, maintain the vacuum integrity of these connections during operation.

Figure 3:
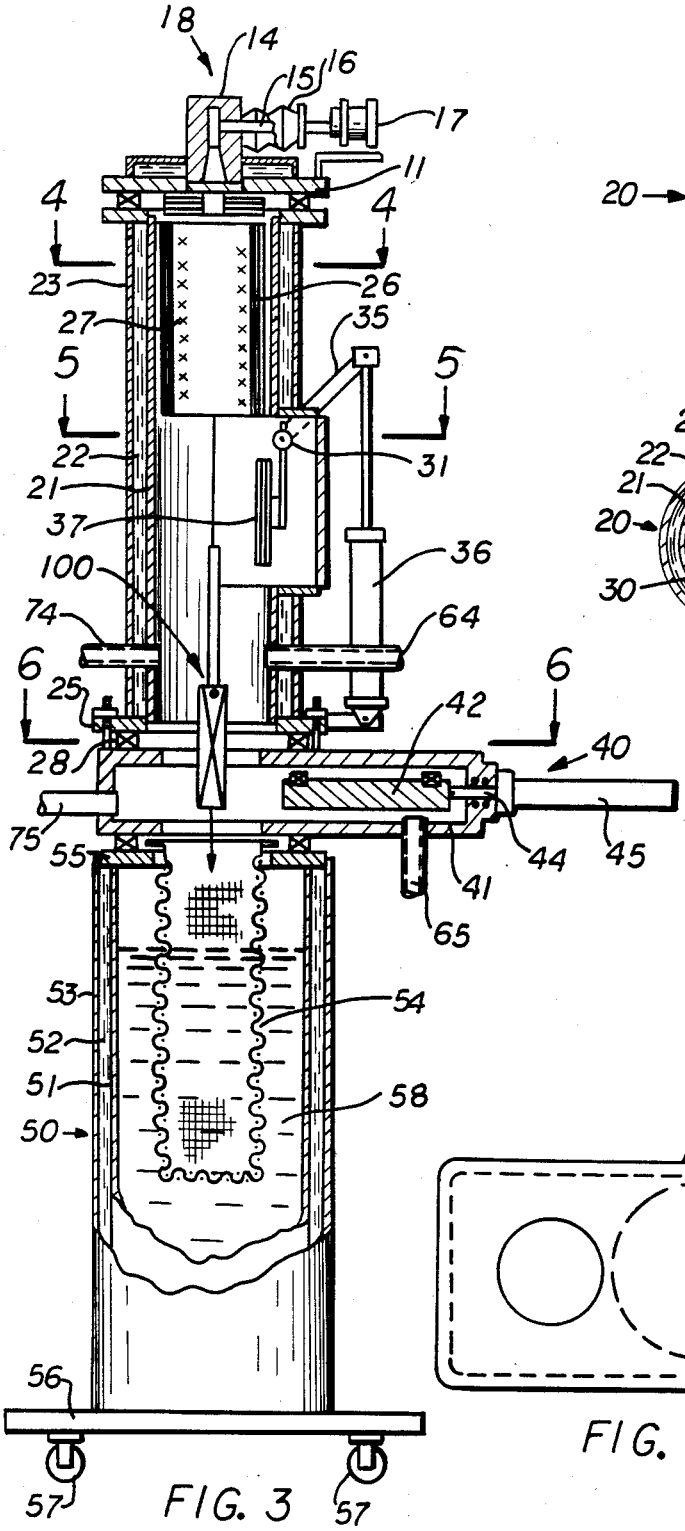
FIG. 3 is a cross-sectional elevation view of the furnace system, during the free-fall transition period from heat to quench.
Figure 4:
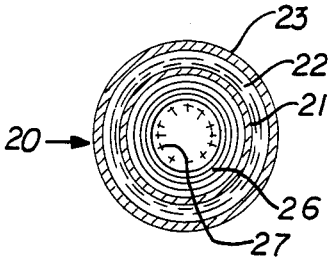
FIG. 4 is a cross-sectional view taken along lines 4—4 of FIG. 3.
Figure 5:
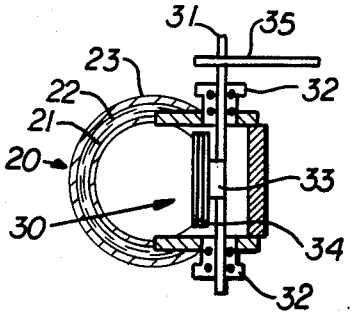
FIG. 5 is a cross-sectional view taken along lines 5—5 of FIG. 3.

The underside hot zone assembly 30 is a two position assembly. The underside insulation 34 is connected to a rotatable shaft 31 by a metallic support and connecting frame 33 as illustrated in FIG. 1 and FIG. 5. The said shaft 31 penetrates an enclosure attached to the chamber 20 encloses a recess through vacuum rotary seals 32. The said shaft 31 is rotatable 90° by the external attached lever arm 35 and the cylinder actuating means 36. Although, a cylinder actuating means 36 is illustrated, other conventional methods may be employed. The closed position of the underside hot zone assembly 30 is shown in FIG. 1, which is its normal position and where it is maintained during the temperature heat and hold segments of the heat treat cycle. The open position of the under side assembly 30 is illustrated in FIG. 3 and FIG. 5 to which it is temporarily positioned, just prior to release of, and during the free-fall of the load assembly 100.

Figure 6:
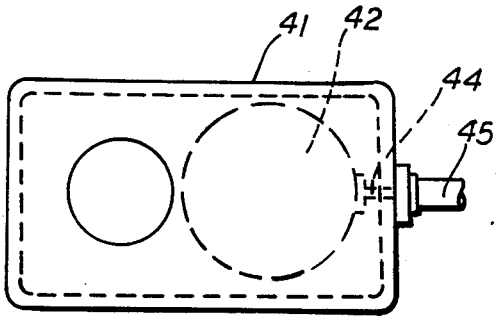
FIG. 6 is a cross-sectional view taken along lines 6—6 of FIG. 3.

The vacuum gate valve assembly 40 may be a standard vendor or vendor type vacuum gate valve assembly. The O-ring 43 in the valve gate 42 is positioned to face the vacuum chamber 20. The operation of the valve gate 42, is two-position, and is either in the full-closed or the full-open position. The valve gate is moved by the actuator stem 44 that penetrates to the exterior and which is actuated by a cylinder 45, or other conventional actuating means. The normal position for the valve gate 42 is in the full-closed position, where it is maintained during the temperature heat and hold segments of the heat treat cycle, as is illustrated in FIG. 1. The full-open position of the said gate 42 is shown in FIG. 3 and FIG. 6 to which it is temporarily positioned, just prior to release of, and during the free-fall of the load assembly 100. The said gate 42 is immediately returned to its full-closed position after said load assembly 100 has passed through the passageway..

The quench tank assembly 50 consists generally of the tank inner casing 51, the tank outer casing 53, a tank top flange 55, a tank bottom plate 56, a cooling medium 52 and tank wheels 57. The said operating tank 50 contains the quench liquid 58 and a load catch basket 54. The said quench tank assembly 50 is movable.

The chamber top cover assembly 10 is an assembled unit consisting generally of a cover head 11, the cover outer casing 13, the cover coolant 12, the top cover insulation 19, and the compound latch-unlatch assembly 18. As described previously the said top cover assembly 10 is movable to and from the position as shown by the solid lines in FIG. 1.

The compound latch-unlatch assembly 18 is shown in more detail in FIGS. *7a* and *7b*. The basic components for the said assembly 18 are a hanger rod receptacle 14, a detent pin 15, a high vacuum bellows seal 16 and a cylinder actuator 17. The high vacuum seal 16 is shown as a bellows type seal, however, other conventional high vacuum seals may be suitable. The movement of the detent pin 15 is shown as actuated by a cylinder actuator 17, however, other actuating means can also be employed.

The said assembly 18 is centrally mounted in a vacuum tight manner to the cover head 11. A vacuum tight weld joins the hanger rod recepticle 14 to the cover head 11. Other joining means such as a screwed connection or a flanged connection can be used, provided the joint is suitable for high vacuum service.

Through holes are provided in the cover head 11 and also in the top cover insulation 19, concentric with the recess hole in the hanger rod receptacle 14. To charge the top cover assembly 10 with a load assembly 100, the load hanger rod 104 is inserted from the underside of said assembly 10 into the hanger rod receptacle 14 and the detent pin 15 is activated by cylinder actuator 17 to engage and hold the hanger rod 104. The rod 104 has a circumferential groove at the detent pin location, as shown in FIG. *7a*. The detent pin 15 engages into the groove to assure a positive latch to hold and suspend the load assembly 100. The actuator 17 can be actuated at any desired time to move the detent pin 15 to the unlatch position, thereby releasing the load hanger rod 104 with its attached load 102 and permitting to free-fall into the quench tank.

FIG. *7b* shows a modified embodiment of the compound latch-unlatch assembly 18. In a small furnace with a light load the load hanger rod 104 can be wire size and a circumferential groove would not be required. With a light load, the force exerted by the actuator 17 can provide enough pressure so that friction is adequate to hold and suspend the load assembly 100.

FIG. 2 illustrates in block single line fashion, the electric power system assembly 80, the vacuum pumping system assembly 60 and the atmosphere gas system assembly 70. These systems can be programmed and operated at various levels within the operating capabilities of the furnace system to meet the heat treat cycle requirements.

The heating elements 27 are connected to the electric power system 81 by means of power feed throughs 82 which penetrate the vacuum heating chamber 20.

FIG. 2 also illustrates in block fashion the vacuum pumping system assembly 60 and the atmosphere backfill and pressure level control system 70. As illustrated each of these systems is subdivided into two circuits, one of which is connected to and penetrates the vacuum heating chamber 20 at the penetrations 64 and 74, the other circuits are connected to the quench tank side of the vacuum gate valve assembly 40 at the penetrations 65 and 75. The chamber side gas valve train 72 works in conjunction with the corresponding vacuum system valve train 62 to achieve and control the desired pressure levels in the vacuum heating chamber assembly 20. The quench tank side of the gas valve train 73 works in conjunction with the corresponding vacuum system valve train 63 to achieve and control the desired pressure levels in the quench tank.

It is understood that when the valve gate 42 is in the closed position as shown in FIG. 1, the pressure level in the vacuum heating chamber assembly 20, and the pressure level in the quench tank assembly are independently controlled and that the pressure levels, may or may not, coincide.

One of the advantages embodied in this invention as illustated in FIG. 1 and FIG. 2 is that during operation, the pressure level in the vacuum heating chamber assembly 20 is set and controlled at its optimum pressure level and at the same time, and independently, the pressure level in the quench tank assembly 50 is set and controlled at its optimum level. At quench time, or just prior to quench and during the free-fall time of the load assembly 100, while the valve gate 42 is open, the two chambers are at the same pressure level. The pressure level selected for this period is the best possible for the particular conditions. The added advantage is that since the valve gate 42 is open for just a short period of time, the adverse conditions and interactions which occur between the vacuum heating chamber assembly 20 and the quench liquid 58 is minimized.

Figure 8:
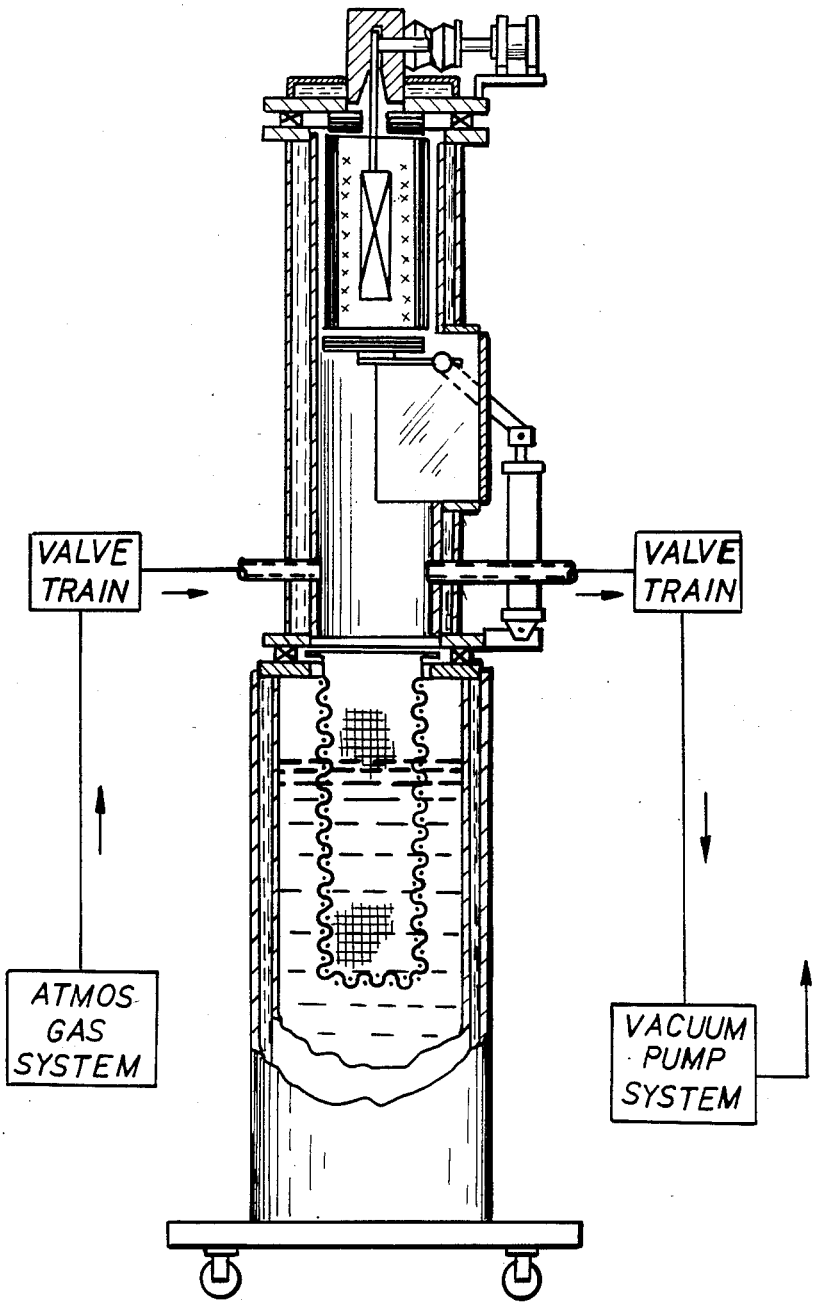
FIG. 8 is a cross-sectional elevation view of the modified embodiment of the vacuum heat treating furnace and quench system.

There are, however, some operating conditions of temperature and pressure levels when combined with a low vapor-pressure quench fluids when operation with the valve gate 42 continuously open would not be harmful, either to the hot zone interior or the load 102. For this particular set of conditions the vacuum gate valve assembly 40 and the quench side valve trains 63 and 73 can be deleted. FIG. 8 illustrates this modified embodiment of the invention.

Figure 9:
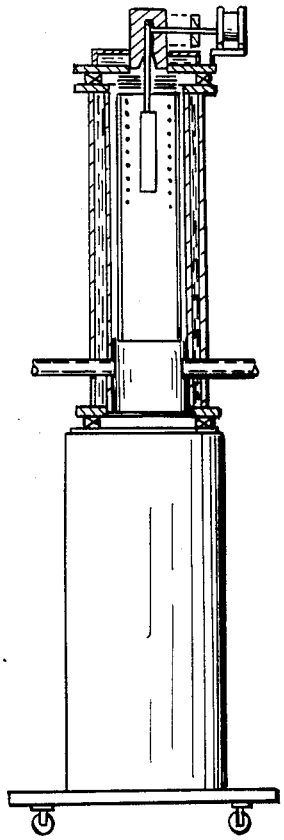
FIG. 9 is a cross-sectional elevation view of another preferred embodiment of the vacuum heat treating furnace and quench system; and, FIG. 10 is a cross-sectional elevation view of another preferred embodiment of the vacuum heat treating furnace and quench system.

Another preferred embodiment of the vacuum furnace and quench system is shown in FIG. 9. This arrangement differs from FIG. 8, in that the underside hot zone assembly 30 has been deleted. This embodiment is applicable for those operating conditions of temperature and pressure and with relative internal dimensions, wherein, a completely open passageway is not harmful either to the hot zone interior or the load 102.

Figure 10:
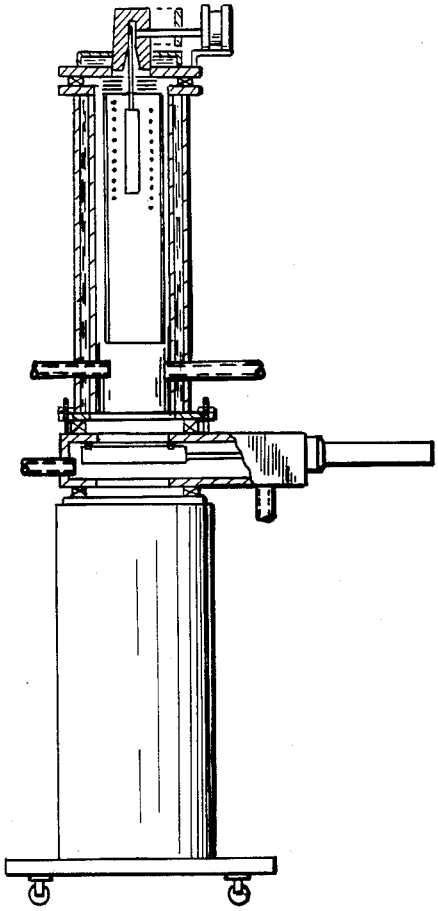

FIG. 10 illustrates yet another preferred embodiment, which is similar to that of FIG. 9 but with a vacuum gate valve interposed between the heating chamber and the quench tank.

OPERATION

Figure 7A:
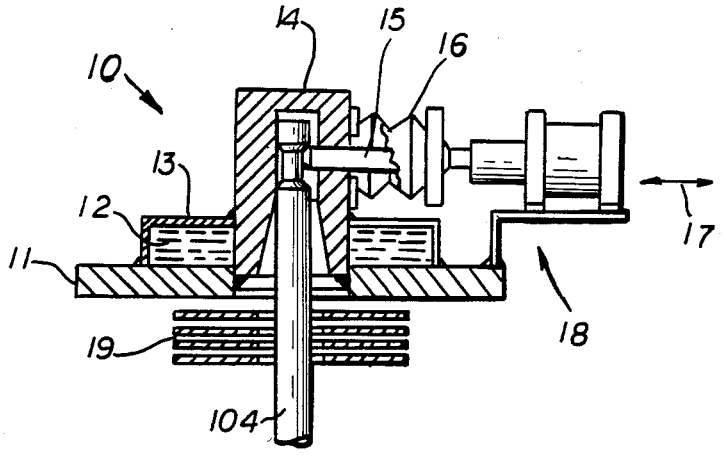
FIGS. 7*a* and 7*b* are sectional views through the chamber top cover assembly illustrating the compound latch-unlatch assembly with a load hanger rod and with a load hanger wire.
Figure 7B:
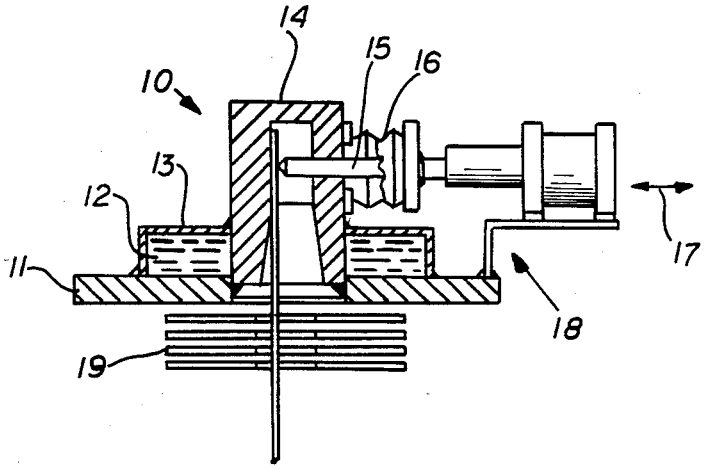

A load 102 and load hanger rod 104 are coupled together to form a load asembly 100 as is illustrated by the dotted line assembly shown in FIG. 1. The top cover assembly 10 is also at the remote position as illustrated by the dotted line outline. The load hanger rod 104 is then inserted into the hanger rod receptacle 14 and the detent pin 15 is actuated to latch and retain the rod as is illustrated in FIG. 7.

The combined cover assembly 10 with the suspended load assembly 100 is then moved and set into position, for heat treatment, as illustrated by the solid lines in FIG. 1. The initial starting location for the underside hot zone assembly 30 and the valve gate 42 in their full closed position as is shown in FIG. 1. The quench tank assembly 50 is in-line and directly under the vacuum gate valve assembly 40. The support member 90, shown in FIG. 2, is in its lowered position and to the extend that the vacuum gasket seal 28 at the valve and quench tank interface is compressed sufficiently to maintain the vacuum integrity of the connection during operation. The solid line illustration of FIG. 1 depicts the starting position of furnace system.

With the furnace loaded and positioned as illustrated in FIG. 1, the vacuum pumping system assembly 60 and the atmosphere backfill and pressure level control system 70 can be activated and operating. By means of the chamber side vacuum system value train 62 and the chamber side gas valve train 72, the vacuum heating chamber assembly 20 can be pumped down and the pressure controlled at the desired operating pressure level. At the same time, the quench tank assembly 50 can be evacuated and controlled at is desired operating pressure level, by means of the quench tank side valve trains 63 and 73.

The heat elements 27 can be energized and controlled by the electric power system 80 to satisfy the time-temperature requirements of the heat-treat cycle.

At the end of the heat segment of the heat treat cycle, and just prior to quench, the pressure levels in both the vacuum heating chamber assembly 20 and the quench tank assembly 50 are equalized to a common pressure level. At quench time the underside hot zone assembly 30 and the valve gate 42 are activated to their open positions, which provides a clear passageway from the vacuum chamber hot zone to the quench liquid. With the passageway clear, the suspended load assembly 100 is unlatched from the latch-unlatch assembly 18 and permitted to free-fall. FIG. 3 illustrates the falling load assembly 100 passing through the passageway.

As soon as the load assembly 100 has cleared the valve gate 42, the underside hot zone assembly 30 and the valve gate 42 are reactivated and returned to their normal closed positions, and then after closure the pressure levels in the vacuum heating chamber 20 and the quench tank assembly 50 are reset to their individual desired pressure levels.

The total time to open the underside assembly 30 and the valve gate 42, permit the load to free-fall and then reclose the said underside assembly 30 and valve gate 42, is very short. A load travel time of four feet calculates out to 0.5 seconds as determined by the known equation of motion $$t = \sqrt{\frac{2s}{g}}.$$

or may be calculated as $S=\frac{1}{2}gt^2$, while a travel of sixteen feet is found to be 1.0 seconds. The total elapsed time is simply the load travel time plus underside assembly 30 and valve gate 42 activation time.

After the load assembly 100 has transferred to the quench tank assembly 50 and the valve gate 42 is in the closed positon, the vacuum heating chamber 20 is now empty, and may now be cooled, backfilled and prepared to be recharged. The quench tank assembly 50 may remain in place for a prescribed length of time, then backfilled and released to atmosphere. At this time, the support actuator 92, illustrated in FIG. 2, is activated to its raised position and thereby raising the support member 90 along with the vacuum chamber and valve assemblies 20 and 40. This vertical movement provides a clearance at the vacuum gate valve assembly and quench tank top flange interface. The quench tank assembly 50 may now be moved to a remote location as shown in FIG. 1 by the dotted line location for removal of the load assembly 100.

The load hanger rod 104 is disengaged from the load 102 and if desired or necessary may be cleaned prior to reuse in the vacuum heating chamber assembly 20.

After removal of the load assembly 100 from the quench basket 54, the quench tank assembly 50 is repositioned under the furnace assembly, in preparation for the next cycle.

While the present invention has been disclosed in connection with the preferred embodiment thereof, it should be understood that there may be other embodiments which fall within the spirit and scope of the invention as defined by the following claims.

The embodiments of the invention in which an exclusive property or privilege is claimed are defined as follows:

1. A vacuum heat treating furnace and quench system, comprising:
   - an upright vacuum chamber assembly having an open top end and an open bottom end,
   - a heating zone inside the upright vacuum chamber assembly, heating means in said heating zone,
   - a removable chamber top cover assembly supported on said open top end,
   - a latch-unlatch means mounted on the chamber top cover assembly and disposed on the outer side of said top cover assembly remote from said heating zone for suspending and releasing loads,
   - a quench tank assembly located directly below the heating zone.

2. A vacuum heat treating furnace and quench system as in claim 1 comprising:

an atmosphere backfill and pressure level control system connected to the vacuum chamber asembly, a vacuum pumping system connected to the vacuum chamber assembly.

3. A vacuum heat treating furnace and quench system as in claim 1 comprising:

means to support the vacuum chamber assembly over the quench tank, means to provide vertical movement to the vacuum chamber assembly to permit engagement, disengagement and horizontal movement of the quench tank assembly.

4. A vacuum heat treating furnace and quench system as in claim 1 further comprising:

means for moving the quench tank assembly away from the upright vacuum chamber assembly to provide access to the quench tank.

5. A vacuum heat treating furnace and quench system as in claim 1 wherein the load hanger means comprises a detent pin and means for actuating the detent pin, a load hanger rod, the load hanger rod is engaged and supported by the detent pin to hold a load in the heating zone, the detent pin having means to release the load hanger rod to drop said load.

6. A vacuum heat treating furnace and quench system comprising:

an upright vacuum chamber assembly having an open upper end and an open lower end, with a heating zone in the upper portion, a removable chamber top cover assembly, a latch-unlatch means mounted on the chamber top cover assembly and disposed on the outer side of said top cover assembly remote from said heating zone for suspending and releasing loads, a bottom heating zone underside heat shield assembly with means to pivotally attach said heat shield assembly to said chamber and swingable from a position extending across said chamber to a position at a side of said chamber to provide a clear passageway for a load free falling from said latch-unlatch means into a quench tank, said quench tank with a quench medium contained therein, located directly below the heating zone.

7. A vacuum heat treating furnace and quench system, as in claim 6, comprising:

an atmosphere backfill and pressure level control system connected to the vacuum chamber assembly, a vacuum pumping system connected to the vacuum chamber assembly.

8. A vacuum heat treating furnace and quench system, as in claim 6, comprising:

means to support the vacuum chamber assembly over the quench tank, means to provide vertical movement to the vacuum chamber assembly to permit engagement, disengagement and horizontal movement of the quench tank assembly.

9. A vacuum heat treating furnace and quench system as in claim 6 further comprising:

means for moving the quench tank assembly away from the upright vacuum chamber assembly to provide access to the quench tank.

10. A vacuum heat treating furnace and quench system as in claim 6 wherein the load hanger means comprises a detent pin and a means for actuating the detent pin, a load hanger rod, the load hanger rod is engaged and supported by the detent pin to hold a load in the heating zone, the detent pin release the load hanger rod to drop a load.

11. A vacuum heat treating furnace and quench system, comprising:

an upright vacuum chamber assembly having an open upper end and an open lower end, a heating zone inside the upright vacuum chamber assembly, a removable chamber top cover assembly, a latch-unlatch means mounted on the chamber top cover assembly and disposed on the outer side of said top cover assembly remote from said heating chamber for suspending and releasing loads, means for limiting the temperature of said latch-unlatch means, a quench tank assembly located directly below the heating zone, a vacuum gate assembly mounted to the underside of said vacuum chamber assembly.

12. A vacuum heat treating furnace and quench system as in claim 11 comprising:

a vacuum pumping system connected to both the vacuum heating chamber side of the vacuum gate valve assembly and also to the quench tank assembly side of said gate valve, in a parallel fashion and manner as as to permit atmosphere evacuation or pressure level control in either location, either independently or simultaneously, an atmosphere backfill and pressure level control system connected to both the vacuum heating chamber side of the vacuum gate valve assembly and also to the quench tank assembly side of said gate valve in a parallel fashion and manner so as to permit backfill or pressure level control in either location, either independently or simultaneously.

13. A vacuum heat treating furnace and quench system as in claim 11 comprising:

means to support the vacuum chamber assembly over the quench tank, means to provide vertical movement to the vacuum chamber assembly to permit engagement, disengagement and horizontal movement of the quench tank assembly.

14. The vacuum heat treating furnace and quench system recited in claim 1 wherein a means is provided for limiting the temperature of the latch-unlatch means and hanger means to prevent property changes at said surfaces.

15. The vacuum heat treating furnace and quench system recited in claim 6 wherein an enclosure defining a recess is provided on a side of said chamber adjacent said heat shield, said heat shield is swingable into said recess.

16. The vacuum heat treating furnace and quench system recited in claim 1 wherein said heating means being in said heating zone, said heating zone having a heated section, a non-heated section and a lateral dimension, said non-heated section having a substantial length below said heated section.

17. The vacuum heat treating furnace and quench system recited in claim 6 wherein means is provided on said furnace for limiting the temperature of said latch-unlatch means to prevent property changes at said latch-unlatch means.

* * * * *